United States Patent [19]

Barrington

[11] 4,064,937

[45] Dec. 27, 1977

[54] ANNULUS PRESSURE OPERATED CLOSURE VALVE WITH REVERSE CIRCULATION VALVE

[75] Inventor: Burchus Q. Barrington, Duncan, Okla.

[73] Assignee: Halliburton Company, Duncan, Okla.

[21] Appl. No.: 769,129

[22] Filed: Feb. 16, 1977

[51] Int. Cl.[2] ..... E21B 43/12; E21B 47/00

[52] U.S. Cl. ..... 166/162; 166/321

[58] Field of Search ..... 166/162, 264, 317, 319, 166/321, 323; 175/318

[56] References Cited

U.S. PATENT DOCUMENTS

| | | | |
|---|---|---|---|
| 3,850,250 | 11/1974 | Holden et al. | 166/315 |
| 3,856,085 | 12/1974 | Holden et al. | 166/264 |
| 3,858,649 | 1/1975 | Wray et al. | 166/264 |
| 3,930,540 | 1/1976 | Holden et al. | 166/315 |
| 3,970,147 | 7/1976 | Jessup et al. | 166/250 |
| 3,976,136 | 8/1976 | Farley et al. | 166/264 |

*Primary Examiner*—James A. Leppink
*Attorney, Agent, or Firm*—Floyd A. Gonzalez; John H. Tregoning

[57] ABSTRACT

A closure valve for use in oil well testing is presented which provides a full opening flow passage therethrough, and which includes a reverse circulation valve. The closure valve is operated by a power mandrel which is responsive to well annulus pressure, and which is frangibly held in the open position until a predetermined pressure is applied to the fluid in the well annulus. The power mandrel is then frangibly released and moves the closure valve to the closed position. The power mandrel is then disconnected from the closure valve operating mechanism and continues to move to activate a circulation valve opening mechanism. The closure valve includes two normally open ball valves which are spaced apart to trap a sample of formation fluid therebetween when the ball valves are closed.

7 Claims, 11 Drawing Figures

ANNULUS PRESSURE OPERATED CLOSURE VALVE WITH REVERSE CIRCULATION VALVE

BACKGROUND OF THE INVENTION

This invention relates to an apparatus for testing an oil well, and more particularly relates to a full opening closure valve which operates responsive to annulus pressure and includes a reverse circulation valve.

Various tester valves and sampler valves for testing oil wells have been developed over the recent years which are responsive to changes in annulus pressure for opening and closing the valves. Reverse circulation valves responsive either to the operation of an annulus pressure responsive tester valve or responsive themselves to annulus pressure changes have also been developed. For instance, U.S. Pat. No. 3,850,250 issued Nov. 26, 1974 and U.S. Pat. No. 3,930,540 issued Jan. 6, 1975, both to Holden et al and assigned to the assignee of the present invention, disclose a circulation valve which opens after a predetermined number of annulus pressure changes have been applied to the well annulus.

U.S. Pat. No. 3,823,773 issued July 16, 1974 to Nutter discloses a circulation valve which is an integral part of a sampler mechanism wherein the sampler mechanism opens and closes responsive to pressure changes in the well annulus. The circulation valve disclosed therein moves from a closed position to an open position after a predetermined number of operations of the sampler valve. Also pertinent to the present invention is U.S. Pat. No. 3,970,147 issued July 20, 1976 to Jessup et al. and assigned to the assignee of the present invention. That patent discloses a circulation valve which moves to a locked open position repsonsive to an increase in annulus pressure above a given value. One embodiment shows a circulation valve which is an integral part of a sliding sleeve type normally open tester valve, arranged such that the tester valve closes prior to the opening of the circulation valve.

The dual CIP reverse circulating valve offered by Halliburton Services of Duncan, Oklahoma is a reverse circulating valve in which spring loaded fingers hold a sliding sleeve mandrel in a position covering reverse circulating ports in a housing of the valve. The sleeve mandrel is spring loaded toward the open position. The dual CIP reverse circulating valve is operated by drill pipe rotation wherein rotation advances an operating mandrel which also opens and closes a tester valve mechanism. After a predetermined number of rotations the tester valve is closed and additional rotation activates a releasing mechanism which releases the fingers holding the sliding sleeve valve mandrel. The sliding sleeve mandrel is then moved to the open position by the mentioned spring, thereby uncovering the circulating ports to allow reverse circulation.

U.S. Pat. No. 3,856,085 issued Dec. 24, 1974 to Holden et al and assigned to the assignee of the present invention discloses an annulus pressure operated well testing apparatus which includes a full opening ball valve for providing a fully opened passageway through the testing string to the formation to be tested.

The apparatus of the present invention is a normally open closure valve which, when in the open position, provides a fully open flow passage therethrough, and which closes after a predetermined pressure increase has been applied to the fluid in the well annulus. This closure valve may be positioned immediately above a tester valve to ensure that at the end of a program of formation testing the valve string is closed, thus isolating the formation to be tested, before the packer is unseated. The closure valve in the preferred embodiment is a ball valve designed such that the valve is only operated one time during the testing program. This design eliminates wear on the components of the valve to minimize the possibility of the valve failing to fully close when desired. The closure valve includes a reverse circulating valve which is moved to the open position after the closure valve has been closed. The closure valve and the reverse circulating valve are operated by an operating mandrel which disconnects from the operating mechanism of a closure valve after the closure valve is moved to the closed position. The operating mandrel continues to move under the influence of annulus pressure to activate a mechanism for opening the reverse circulating valve.

In the preferred embodiment the closure valve includes two full opening ball valves which operate simultaneously. This arrangement provides that a sample of formation fluid may be trapped between the two full opening valves when they are closed. This arrangement ensures that a representative sample of formation fluid flowing in the testing string during the formation testing program is entrapped by two valves have not been closed heretofore during the testing program.

The activating mechanism for closing the ball valves simultaneously is identical to that disclosed in a U.S. patent application filed on the same date as the present application by Robert Jessup and assigned to the assignee of the present application, and claimed therein as the invention of Robert Jessup.

The invention of the present application results in a closure valve which ensures that the testing string is closed before the packer in the testing string is unseated at the end of a testing program. The closing of the closure valve also initiates the opening of a reverse circulating valve which is not opened until after the closure valve has closed to ensure that pressure transients are not recorded in the well testing recording devices. The closure valve of the present invention also includes a sample chamber between two ball valves which entraps a sample of formation fluid when the closure valve moves to the closed condition. When in the open condition during the testing program the two ball valves provide a fully opened passageway through the closure valve through which various well tools may pass. The fully opened fluid passageway through the closure valve is also highly desirable when testing wells with high flow rate to achieve maximum accuracy in the testing program.

BRIEF DESCRIPTION OF THE DRAWINGS

The apparatus of this invention is illustrated in the attached drawings which include.

OVERALL WELL TESTING ENVIRONMENT

During the course of drilling an oil well, the borehole is filled with a fluid known as drilling fluid or drilling mud. One of the purposes of this drilling fluid is to contain in intersected formations any fluid which may be found there. To contain these formation fluids the drilling mud is weighted with various additives so that the hydrostatic pressure of the mud at the formation depth is sufficient to maintain the formation fluid within the fomation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string is then opened and the formation fluid, free from the restraining pressure of the drilling fluid, can flow into the interior of the testing string.

The testing program includes periods of formation flow and periods when the formation is closed in. Pressure recordings are taken throughout the program for later analysis to determine the production capability of the formation. If desired, a sample of the formation fluid may be caught in a suitable sample chamber.

At the end of the testing program, a circulation valve in the test string is opened, formation fluid in the testing string is circulated out, the packer is released, and the testing string is withdrawn.

Over the years various methods have been developed to open the tester valves located at the formation depth as described. These methods include string rotation, string reciprocation, and annulus pressure changes. One particularly advantageous tester valve is that shown in U.S. Pat. No. 3,856,085 issued Dec. 24, 1974 to Holden et al. This valve operates responsive to pressure changes in the annulus and provides a full opening flow passage through the tester valve apparatus.

The annulus pressure operated method of opening and closing the tester valve is particularly advantageous in offshore locations where it is desirable to the maximum extent possible, for safety and environmental protection reasons, to keep the blowout preventers closed during the major portion of the testing procedure.

Figure 1:
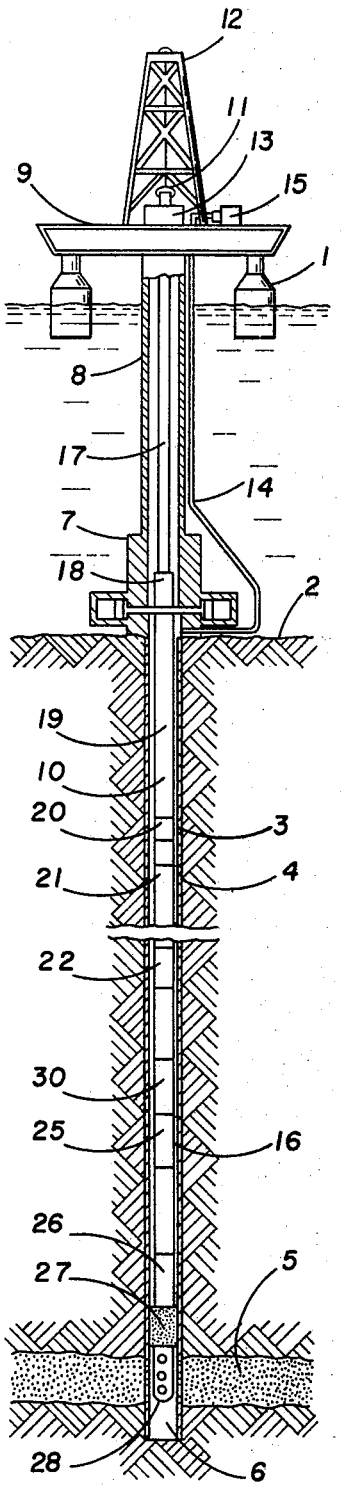
FIG. 1 is a schematic elevational view of a typical well testing apparatus using the invention.
Figure 2A:
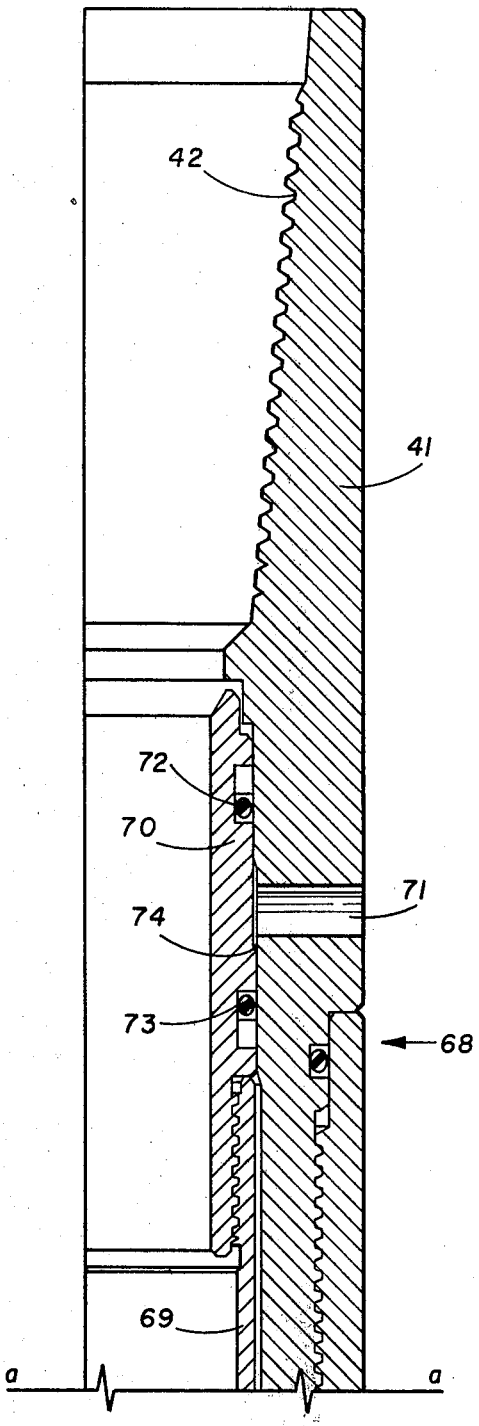
FIG. 2*a* – FIG. 2*i*, joined along section lines *a—a* through *h—h*, provides a right side only cross-sectional view of the invention with the closure valve in the open position and the circulation valve in the closed position.
Figure 2B:
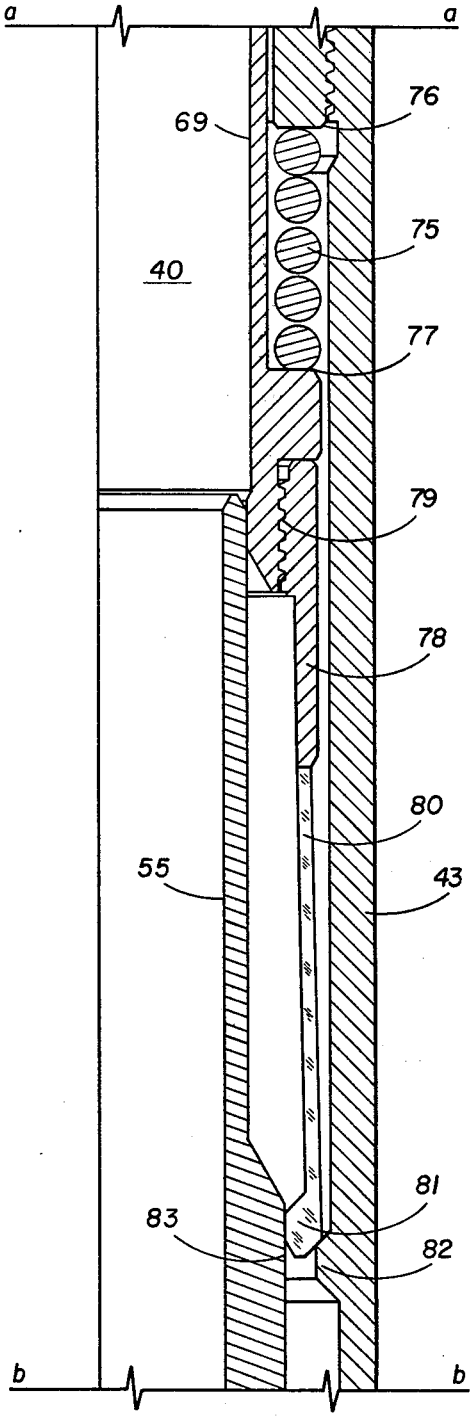
Figure 2C:
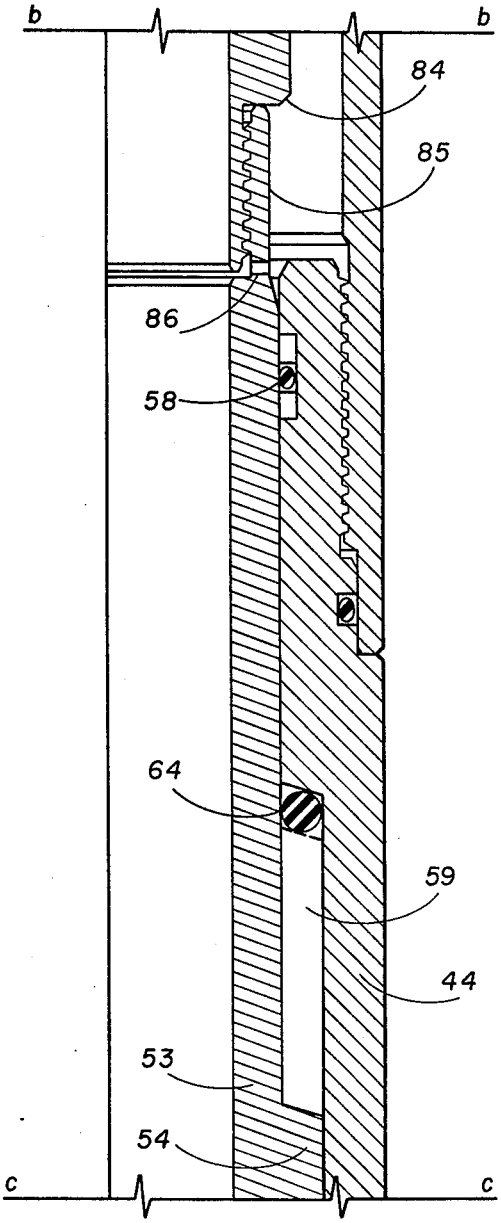

A typical arrangement for conducting a drill stem test offshore is shown in FIG. 1. Such an arrangement would include a floating work station 1 stationed over a submerged work site 2. The well comprises a well bore 3 typically lined with a casing string 4 extending from the work site 2 to a submerged formation 5. The casing string 4 includes a plurality of perforations at its lower end which provide communication between the formation 5 and the interior of the well bore 6.

At the submerged well site is located the well head installation 7 which includes blowout preventer mechanisms. A marine conductor 8 extends from the well head installation to the floating work station 1. The floating work station includes a work deck 9 which supports a derrick 12. The derrick 12 supports a hoisting means 11. A well head closure 13 is provided at the upper end of marine conductor 8. The well head closure 13 allows for lowering into the marine conductor and into the well bore 3 a formation testing string 10 which is raised and lowered in the well by hoisting means 11.

A supply conduit 14 is provided which extends from a hydraulic pump 15 on the deck 9 of the floating station 1 and extends to the well head installation 7 at a point below the blowout preventers to allow the pressurizing of the well annulus 16 surrounding the test string 10.

The testing string includes an upper conduit string portion 17 extending from the work site 1 to the well head installation 7. A hydraulically operated conduit string test tree 18 is located at the end of the upper conduit string 17 and is landed in the well head installation 7 to thus support the lower portion of the formation testing string. The lower portion of the formation testing string extends from the test tree 18 to the formation 5. A packer mechanism 27 isolates the formation 5 from fluids in the well annulus 16. A perforated tail piece 28 is provided at the lower end of the testing string 10 to allow fluid communication between the formation 5 and the interior of the tubular formation testing string 10.

The lower portion of the formation testing string 10 further includes intermediate conduit portion 19 and torque transmitting pressure and volume balanced slip joint means 20. An intermediate conduit portion 21 is provided for imparting packer setting weight to the packer mechanism 27 at the lower end of the string.

It is many times desirable to place near the lower end of the testing string a conventional circulating valve 21 which may be opened by rotation or reciprocation of the testing string or a combination of both or by the dropping of an opening bomb in the interior of the testing string 10. This circulation valve is provided as a back-up means to provide for fluid communication in the event that the circulation valve of the present apparatus should fail to open properly. Also near the lower end of the formation testing string 10 is located a tester valve 25 which is preferably a tester valve of the annulus pressure operated type such as that disclosed in U.S. Pat. No. 3,856,085. Immediately above the tester valve is located the apparatus of the present invention 30.

A pressure recording device 26 is located below the tester valve 25. The pressure recording device 26 is preferably one which provides a full opening passageway through the center of the pressure recorder to provide a full opening passageway through the entire length of the formation testing string.

It may be desirable to add additional formation testing apparatus in the testing string 10. For instance, where it is feared that the testing string 10 may become stuck in the borehole 3 it is desirable to add a jar mechanism between the pressure recorder 26 and the packer assembly 27. The jar mechanism is used to impart blows to the testing string to assist in jarring a stuck testing string loose from the borehole in the event that the testing string should become stuck. Additionally, it may be desirable to add a safety joint between the jar and the packer mechanism 27. Such a safety joint would allow for the testing string 10 to be disconnected from the packer assembly 27 in the event that the jarring mechanism was unable to free a stuck formation testing string.

The location of the pressure recording device may be varied as desired. For instance, the pressure recorder may be located below the perforated tail piece 28 in a suitable pressure recorder anchor shoe running case. In addition, a second pressure recorder may be run immediately above the tester valve 25 to provide further data to assist in evaluating the well.

DESCRIPTION OF THE PREFERRED EMBODIMENT

Referring now to FIGS. 2*a* through 2*i*, the oil well apparatus 30 includes a tubular outer housing having an upper housing adapter 41 which includes threads 42 for attaching the apparatus into the testing string above the apparatus, a circulation valve housing 43, a power section housing 44, an intermediate housing 45, an upper sampler housing 46, an intermediate sampler housing 47, a lower sampler housing 48, and a lower housing adapter 49 which includes threads 50 for attaching the apparatus into that portion of the testing string which is below the apparatus 30. An open bore 40 is provided through the housing for communication with the flow passage through the testing string. The tool may be conveniently divided into three major assemblies; a power section 51, a circulation valve section 68, and a full opening sampler section 90.

The power section 51 comprises a power port 52 through the power section housing 44 as shown. Slidably located within the apparatus housing is a power mandrel 53 which has an annular piston 54. The power mandrel 53 additionally includes an upper portion 55 and a lower portion 56.

Seals 57 between the annular piston 54 and the power section housing 44 and seals 58 between the power mandrel 53 and the power section housing 44 serve to seal a low pressure chamber 59. It can thus be seen that there will be a differential between the exterior pressure admitted by power port 52 and the pressure that is sealed within chamber 59. Additionally, seals 60 are provided between the power mandrel 53 and exterior housing portion 45 to prevent fluid communication between the well annulus and the interior bore 40 of the apparatus.

Shear pin collar 61 is located between the power piston 53 and the power section housing 44 as shown. The shear pin collar 61 is frangibly attached to the power piston 53 by a plurality of shear pins 62. A shear pin retainer 63 is additionally provided to maintain the shear pins 62 in position during assembly of the tool. It can be seen that the shear pins 62 passing through the shear pin collar 61 and into the power piston 53 will serve to hold the power piston 53 into the position shown until the shear pins 62 are sheared by the pressure differential between the well annulus pressure acting through power port 52 and the pressure in chamber 59.

As is well known, the number of shear pins 62 may be varied to set the value of the pressure differential required to shear the pins and release the power mandrel 53.

An elastomeric cushion ring 64 is located in chamber 59 to help absorb the shock as the power piston 53 moves to the fully upward position under the influence of the pressure admitted by power port 52.

The full opening sampler section 90 includes a sample chamber 89 in the open bore 40 of the apparatus. The sample chamber 89 is formed by the closing of two full opening ball valves 99 and 106.

Figure 2D:
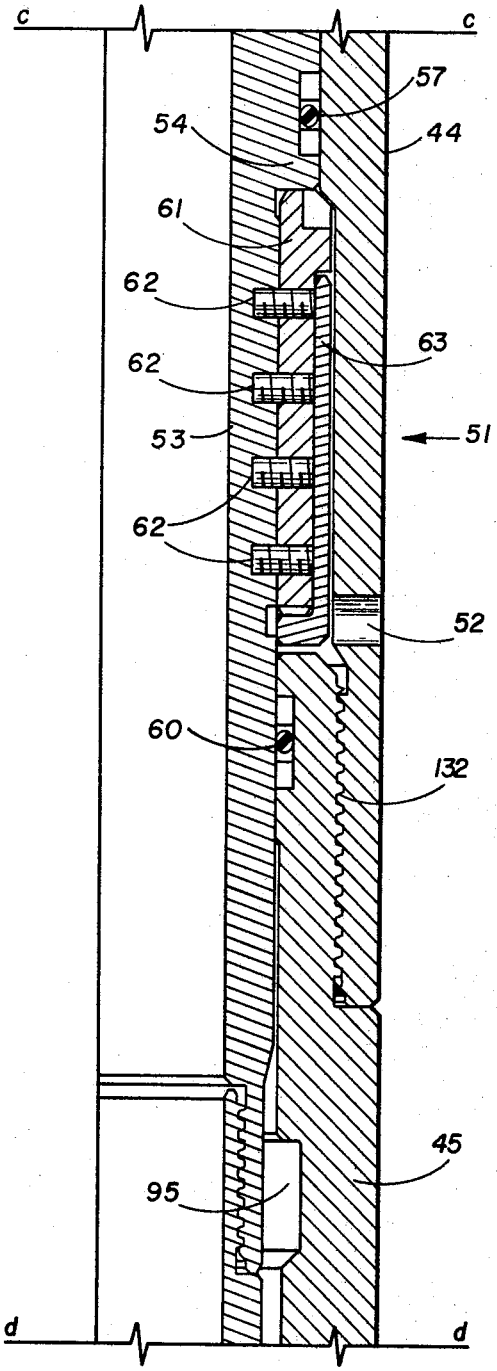
Figure 2E:
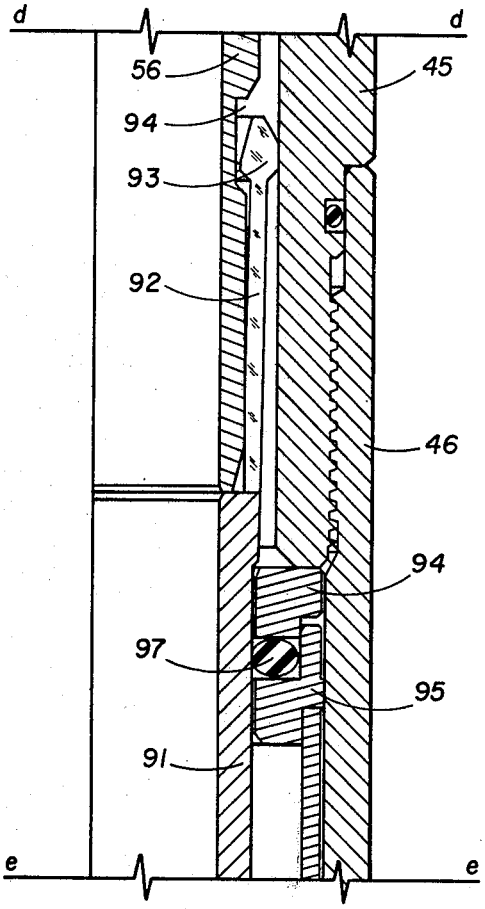
Figure 2F:
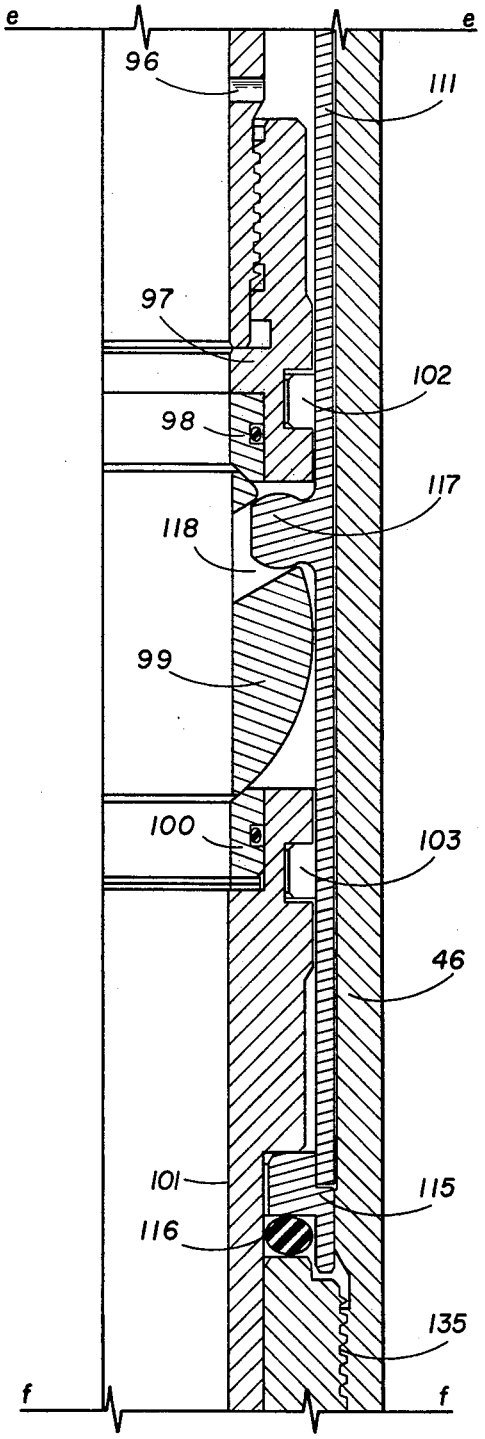
Figure 2G:
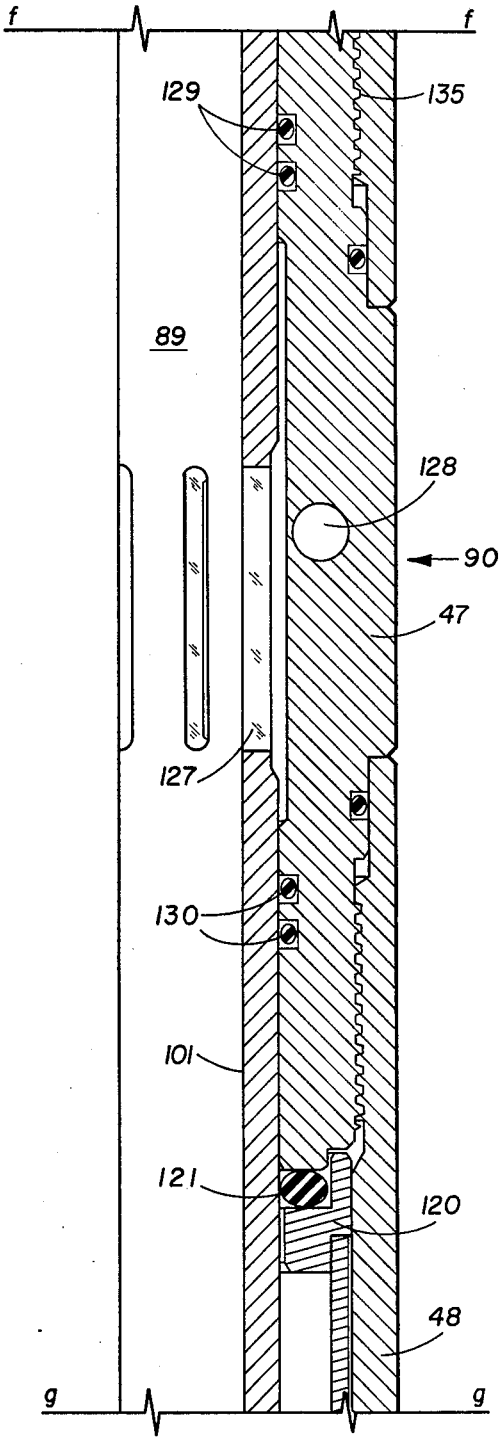
Figure 2H:
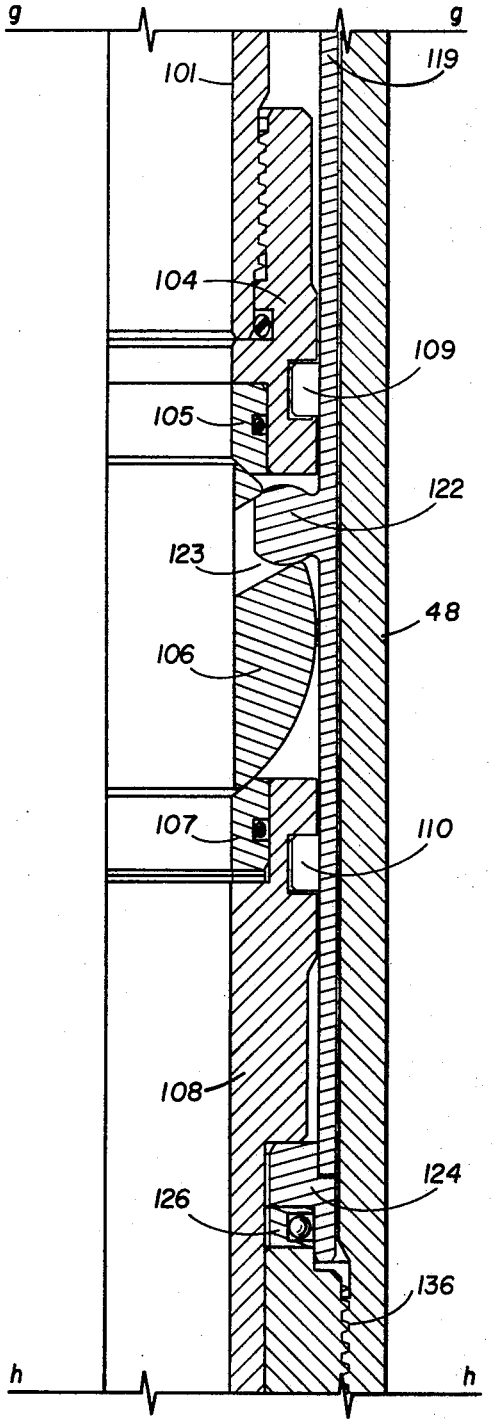
Figure 2I:
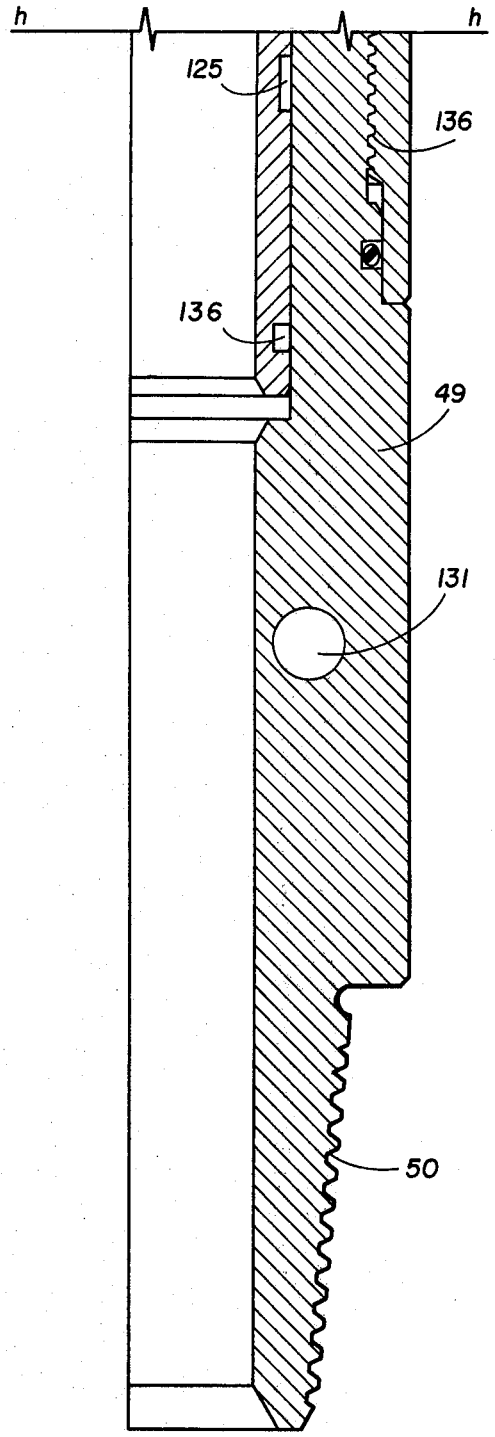

The two ball valves 99 and 106 are simultaneously operated by a dual ball operating assembly which includes a sampler pull mandrel 91 releasably attached to the lower portion 56 of the power mandrel 53 by a plurality of spring fingers 92. Each spring finger 92 is terminated by a head 93. Each of the heads 93 is forced by the intermediate housing 45 into a groove 94 in the lower portion 56 of the pull mandrel 53 as shown in FIG. 2*e*.

The intermediate housing 45 also includes a releasing recess 95.

The spring fingers 92 of the sampler pull mandrel 91 are outwardly biased such that when the heads 93 are pulled by the lower portion 56 of the power mandrel 53 to the releasing recess 95, the spring fingers 92 snap outwardly moving heads 93 into the releasing recess 95. This action disconnects the sampler pull mandrel 91 from the grooves 94 in the lower portion 56 of the power mandrel 53.

The dual ball operating mechanism additionally includes an upper seat retainer 97 for the upper ball valve 99 which retains the upper valve seat 98 as shown. Below seat 98 is the upper ball valve 99 and its associated lower valve seat 100. Located below the upper ball valve 99 is an operating pull mandrel 101 for operating the lower ball valve 106. The upper seat 98 and lower seat 100 are held in sealing engagement with ball 99 by C-clamps (not shown) which are fitted into groove 102 in the upper seat retainer 97 and groove 103 in the operating pull mandrel 101.

Threadably attached to the lower end of the operating pull mandrel 101 is an upper seat retainer 104 for the lower ball valve 106. Upper valve seat 105 is retained in the upper seat retainer 104 as shown.

Lower valve seat 107 is retained in a recess in a lower inner mandrel 108 as shown. Upper seat 105 and lower seat 107 are held in sealing engagement with ball valve 106 by C-clamps (not shown) which are fitted into groove 109 in the upper valve seat retainer 104 and groove 110 in the lower inner mandrel 108 as shown.

It can thus be seen that as power mandrel 53 moves in an upward direction under the influence of well pressure acting upon piston 54, that the entire ball operating assembly comprised of sampler pull mandrel 91, upper seat retainer 97, upper ball valve 99 with its associated valve seats 98 and 100, operating pull mandrel 101, upper seat retainer 104, ball valve 106 and its associated valve seats 105 and 107, and lower inner mandrel 108 all move in the upward direction as long as head 93 is engaged in groove 94. During this upward movement ball valve 99 will be rotated to the closed position by the action of a pin 117 in hole 118. Likewise, ball valve 106 will be rotated to the closed position by the action of a pin 122 in hole 123.

Pin 117 extends inwardly from upper pin mandrel 111 which is held in position in upper sampler housing 46 by the upper cushion retainers 94 and 95 and the lower cushion retainer 115. A cushion 97 is located between cushion retainers 94 and 95 and a lower cushion 116 is located below cushion retainer 115 to assist in absorbing shocks transmitted to the upper pin mandrel 111 by the operation of the upper ball valve 99 as it is moved between the open and closed position.

Likewise, pin 122 is an inwardly directed portion of the lower pin mandrel 119 which is held in position in the lower sampler housing 48 by cushion retainer 120 and lock ring retainer 124. A cushion 121 is located above the upper cushion retainer 120 to assist in absorbing the shocks transmitted to the lower pin mandrel 119 by the action of ball valve 106 as it is moved from the open to the closed position.

The preferred apparatus as disclosed includes a sampler locking mechanism to lock the sampler in the closed position once the operating assembly has rotated both balls to the closed position. This sampler locking mechanism comprises a segmented contracting lock ring 126 located below the lock ring retainer 124 which engages a groove 125 in the lower inner mandrel 108 when the ball valve operating assembly moves upward to the sample entrapping position.

Sampler pull mandrel 91 includes a port 96 to prevent hydraulic lock-up of the operating assembly due to fluids trapped between the operating assembly and the upper pin mandrel 111. It will be noted that seals are not provided between the lower housing adapter 49 and the bottom portion of the lower inner mandrel 108. This allows fluids trapped between the lower portion of the operating assembly and the lower pin mandrel 119 to escape into the inner bore 40 to prevent hydraulic lock-up.

Figure 3:
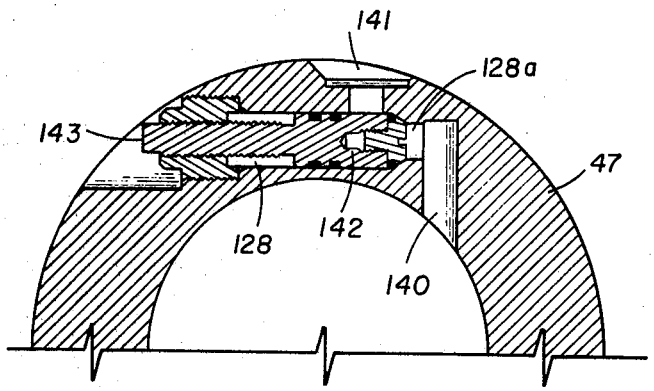
FIG. 3, a cross-sectional view of the drain valve for the sample chamber of the invention.

A means for draining the sample chamber 89 is provided in the wall of the intermediate sampler housing 47, and is shown in cross-section in FIG. 3. A transverse passageway 128 is provided in intermediate sampler housing 47 in which is located a plug valve 142. The stem of the valve 143 is threaded such that the plug valve may be moved by rotation between the closed and open position.

When plug valve 142 is moved to the open position, fluid communication is established through the intermediate sampler housing 47 to the sample chamber 89 by way of interior passageway 140, a connecting portion **128*a* of transverse passageway 128, and exterior drain port 141**.

The apparatus further includes a plurality of slots 127 in the pull mandrel 101 to allow communication between the sample chamber 89 and the interior passageway 140. The interior passageway 140 is sealed by seals 129 and 130 as shown.

As set out above, the present apparatus is most advantageous when run with an annulus pressure operated tester valve such as the one shown in U.S. Pat. No. 3,856,085. When run with such a tester valve, it is desirable to provide a means to drain well fluids trapped between the lower ball 106 and the tester valve located below the present apparatus in the testing string. Thus, a second drain passageway 131 is provided in the lower adapter 49 to allow the draining of formation fluid trapped between the present apparatus and the tester valve. A plug valve similar to the one shown in FIG. 3 may be used in conjunction with passageway 131.

The circulation valve section 68 comprises a circulation valve pull mandrel 69 slidably located within circulation valve housing 43. The circulation valve pull mandrel 69 is threadably attached to a circulation valve sealing mandrel 70 as shown. The circulation valve sealing mandrel 70 sealingly covers circulation port 71 in one position and uncovers the circulation port 71 in a second position.

The circulation port 71 extends through the tubular housing of the apparatus at a convenient place such as the upper housing adapter 41 as shown. The circulation port 71 provides for fluid communication between the well annulus 16 exterior of the apparatus and the central bore 40 through the tubular housing when the circulation port 71 is uncovered.

The circulation port 71 is sealed by appropriate seals 72 and 73 in the circulation valve sealing mandrel 70 as shown. Additionally, the circulation valve sealing mandrel 70 and the tubular housing adapter 41 are so designed to give a small differential area 74 to the sealing mandrel 70 such that hydrostatic pressure in the well annulus acting through circulation port 71 will give a bias to the sealing mandrel 70 toward the open position.

The circulation valve pull mandrel 69 and the attached circulation valve sealing mandrel 70 are additionally biased toward the open position by a compressed opening spring 75 which acts between a thickened portion 76 of the tubular housing and a thickened portion 77 of the pull mandrel.

The circulation valve 68 is maintained in the closed position as illustrated in FIG. 2 by a circulation valve release mandrel 78 which is threaded by attached threads 79 to the circulation valve pull mandrel. The circulation valve release mandrel 78 has a plurality of spring fingers 80 each of which are terminated by a head 81. The head 81 of the spring fingers 80 is held in place by an inwardly directed thickened portion of the circulation valve housing 43 which forms a retaining ledge 82. The spring finger head 81 is held behind the retaining ledge 82 by an outwardly directed thickened portion 83 of the upper portion 55 of the power mandrel 53.

The thickened portion 83 includes a releasing edge 84 as shown in FIG. **2*c*. The spring fingers 80 have an inward bias such that when the releasing edge 84 is advanced by the movement of the power mandrel 53 to a point beyond the head 81, the spring fingers 80 snap inwardly moving the head 81 into the necked down portion 85 of the pull mandrel 53**.

After the releasing of head 81 from retaining ledge 82, the opening spring 75 assisted by hydraulic pressure acting on differential area 74, causes the pull mandrel 69 to pull the circulation valve sealing mandrel 70 to the open position.

A port 86 is provided in the power mandrel 53 to prevent hydraulic lock-up as the power mandrel 53 moves to release the circulation valve release mandrel 78.

After the apparatus has been returned to the surface at the conclusion of the testing program, it is desirable to be able to disassemble the apparatus to an integral sample chamber section. This is desirable in that only the sample chamber filled with formation fluid need be transferred to a laboratory for testing. Also, by providing a separable sample chamber it is possible to transfer the fluid sample from the drilling rig to the laboratory without the possibility of contamination of the well fluid sample.

To facilitate the disassembly of the apparatus into a separable sample section, a threaded connection 132 is provided to separate the sampler section 90 from the power section 51 and the circulating valve section 68.

Many times it is desirable to operate the apparatus as a safety closure valve rather than a sampler section. In these cases it may not be required or desirable to trap a sample of formation fluid. However, it is always desirable to have a safety valve which will close as the circulation valve is opened to ensure that the open bore of the drill string is closed in the event of failure of the tester valve in the case of a drill stem test, or if the apparatus is used as a safety valve during oil well drilling or in a production string.

The present apparatus is so constructed that the bottom ball valve 106 may be removed from the apparatus. The upper ball valve 99 is then used as an emergency closure valve which operates in conjunction with the circulation valve assembly 68.

To remove the bottom ball valve 106 the apparatus is separated at threaded connection 135 and threaded connection 136. The operating pull mandrel 101 is then removed and the lower inner mandrel 108 is substituted therefor below the upper ball valve 99. In this configuration a seal is provided in groove 136 to prevent fluid communication from the lower side to the upper side of the closed ball valve 99 around the pin arm 111. Lock ring 126 is also substituted for cushion 116 to lock the closure valve in the closed position.

The assembly of the apparatus as a closure valve having an integral circulation valve is completed by threadably engaging the lower adapter 49 with the intermediate sampler housing 46 at threaded connection 135.

It is to be understood that the foregoing disclosure and the embodiment described therein is illustrative only, and that the scope of the invention intended to be protected is defined by the appended claims and the equivalents thereof.

What is claimed is:

1. An apparatus for use in testing an oil well having a testing string in a borehole extending from the surface of the earth to a formation to be tested, comprising:

a cylindrical housing adapted to be incorporated in said testing string, having an open bore therethrough, and a power port and a circulating port through the walls thereof;

a power mandrel in said open bore having an annular piston for moving said power mandrel in a first direction responsive to fluid pressure exterior of said cylindrical housing communicated to said annular piston through said power port;

frangible restraining means between said power mandrel and said cylindrical housing for restraining movement of said power mandrel in the first direction until the pressure exterior of said housing exceeds a predetermined value, and for frangibly releasing said power mandrel when said pressure exterior of said housing exceeds said predetermined value;

full opening closure valve means in said cylindrical housing having a normally open position and a closed position for providing a fully open flow passageway through the open bore in said housing when in the normally open position;

connecting means connecting said full opening closure valve means to said power mandrel including means for moving said closure valve from the fully open position to a fully closed position responsive to movement of said power mandrel in the first direction;

first releasing means in said connecting means for selectively releasing said connecting means from said power mandrel after said power mandrel has moved a predetermined distance in the first direction; and circulation valve means in said housing including a sliding valve mandrel having a normally closed position closing said circulating port and an open position opening said circulating port, said circulation valve means including means for moving said sliding valve mandrel from the closed position to the open position responsive to a predetermined amount of movement of said power mandrel in the first direction.

2. The apparatus of claim 1 wherein said circulation valve further comprises:

a cylindrical sleeve mandrel slidably and coaxially located within the open bore of said cylindrical housing, said sleeve mandrel sealingly covering said circulating port in a first position, and movable to a second position uncovering said circulating port;

spring means between said cylindrical sleeve mandrel and said cylindrical housing for spring biasing said cylindrical sleeve mandrel toward the second position;

holding means between said cylindrical sleeve mandrel and said power mandrel for holding said cylindrical sleeve mandrel in said first position; and second releasing means on said power mandrel for releasing said holding means after a predetermined amount of movement of said power mandrel in said first direction.

3. The apparatus of claim 2 wherein said second releasing means is positioned on said power mandrel for releasing said circulation valve holding means after said first releasing means has released said closure valve connecting means from said power mandrel.

4. The apparatus of claim 1 wherein said full opening closure valve means comprises two full opening ball valves spaced apart in said cylindrical housing forming a sample chamber therebetween; and drain valve means in the wall of said cylindrical housing for selectively establishing fluid communication with said sample chamber.

5. An apparatus for use in an oil well comprising:

a cylindrical housing having an open bore therethrough, and a power port and a circulating port through the walls thereof;

a power mandrel in said open bore having an annular piston for moving said power mandrel in a first direction responsive to fluid pressure exterior of said cylindrical housing communicated to said annular piston through said power port;

frangible restraining means between said power mandrel and said cylindrical housing for restraining movement of said power mandrel in the first direction until the pressure exterior of said housing exceeds a predetermined value, and for frangibly releasing said power mandrel when said pressure exterior of said housing exceeds said predetermined value;

full opening sampler means in said cylindrical housing having a normally open position and a closed position, said sampler means including two full opening valves which, when in the open position, provides a fully opened fluid passageway through the open bore in said housing, and which when closed traps a sample of fluid therebetween;

operating means in said full opening sampler means for operating said full opening valves to close simultaneously responsive to movement of said power mandrel in said first direction;

connecting means connecting said operating means to said power mandrel for imparting motion of said power mandrel to said operating means;

first releasing means in said connecting means for selectively releasing said connecting means from said power mandrel after said power mandrel has moved a predetermined distance in the first direction; and circulation valve means in said housing including a sliding valve mandrel having a normally closed position closing said circulating port and an open position opening said circulating port, said circulation valve means including means for moving said sliding valve mandrel from the closed position to the open position responsive to a predetermined amount of movement of said power mandrel in the first direction.

6. The apparatus of claim 5 wherein said circulation valve further comprises:

a cylindrical sleeve mandrel slidably and coaxially located within the open bore of said cylindrical housing, said sleeve mandrel sealingly covering said circulating port in a first position, and movable to a second position uncovering said circulating port;

spring means between said cylindrical sleeve mandrel and said cylindrical housing for spring biasing said cylindrical sleeve mandrel toward the second position;

holding means between said cylindrical sleeve mandrel and said power mandrel for holding said cylindrical sleeve mandrel in said first position; and second releasing means on said power mandrel for releasing said holding means after a predetermined amount of movement of said power mandrel in said first direction.

7. The apparatus of claim 6 wherein said second releasing means is positioned on said power mandrel for releasing said circulation valve holding means after said first releasing means has released said closure valve connecting means from said power mandrel.

* * * * *